United States Patent [19]

Bosi

[11] Patent Number: 4,920,722

[45] Date of Patent: May 1, 1990

[54] COMPOSABLE WELL

[75] Inventor: Giulio Bosi, Conegliano, Italy

[73] Assignee: Europlast S.p.A., Treviso, Italy

[21] Appl. No.: 192,372

[22] Filed: May 10, 1988

[30] Foreign Application Priority Data

May 14, 1987 [IT] Italy ..... 85545 A/87

[51] Int. Cl.[5] ..... E02D 29/12

[52] U.S. Cl. ..... 52/591; 52/20; 52/594; 137/363; 285/921; 405/133; 405/135

[58] Field of Search ..... 52/594, 19, 20, 582, 52/591; 137/363, 370, 364, 367, 370, 371, 373; 285/921; 446/116, 117, 120, 121; 405/133, 134, 135

[56] References Cited

U.S. PATENT DOCUMENTS

| | | | |
|---|---|---|---|
| 115,917 | 6/1871 | Wharton | 285/921 |
| 1,661,674 | 3/1928 | Osborn | 285/921 |
| 2,260,221 | 10/1941 | Gray | 285/921 |
| 2,537,284 | 1/1951 | Schuder | 285/921 |
| 3,825,288 | 7/1974 | Maroschak | 285/921 |
| 4,128,264 | 12/1978 | Oldford | 285/921 |
| 4,275,757 | 6/1981 | Singer | 52/20 |
| 4,779,902 | 10/1988 | Lee | 285/921 |

*Primary Examiner*—John E. Murtagh

*Attorney, Agent, or Firm*—Bucknam and Archer

[57] ABSTRACT

A composable well of right prismatic or right cylindrical shape has a polygonal or circular base respectively, and consists of a plurality of walls (1), the walls having on their lateral borders, on one side a plurality of hooking elements (2) of male type and on the opposite side a plurality of hooking elements (3) of female type. Stable hooking between each wall (1) with the preceding wall and the successive wall is easily achieved. The well may be easily transported and stored in the form of a plurality of walls which are superimposed and occupy little space and is then assembled at the final place. After it is assembled, the well forms a box-type structure, with or without the bottom closure and does not require nails, screws or the like.

3 Claims, 3 Drawing Sheets

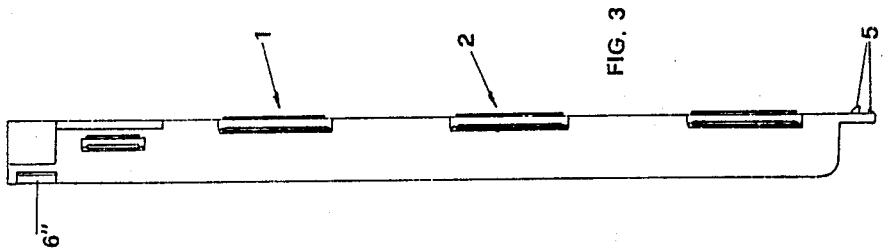
FIG. 3
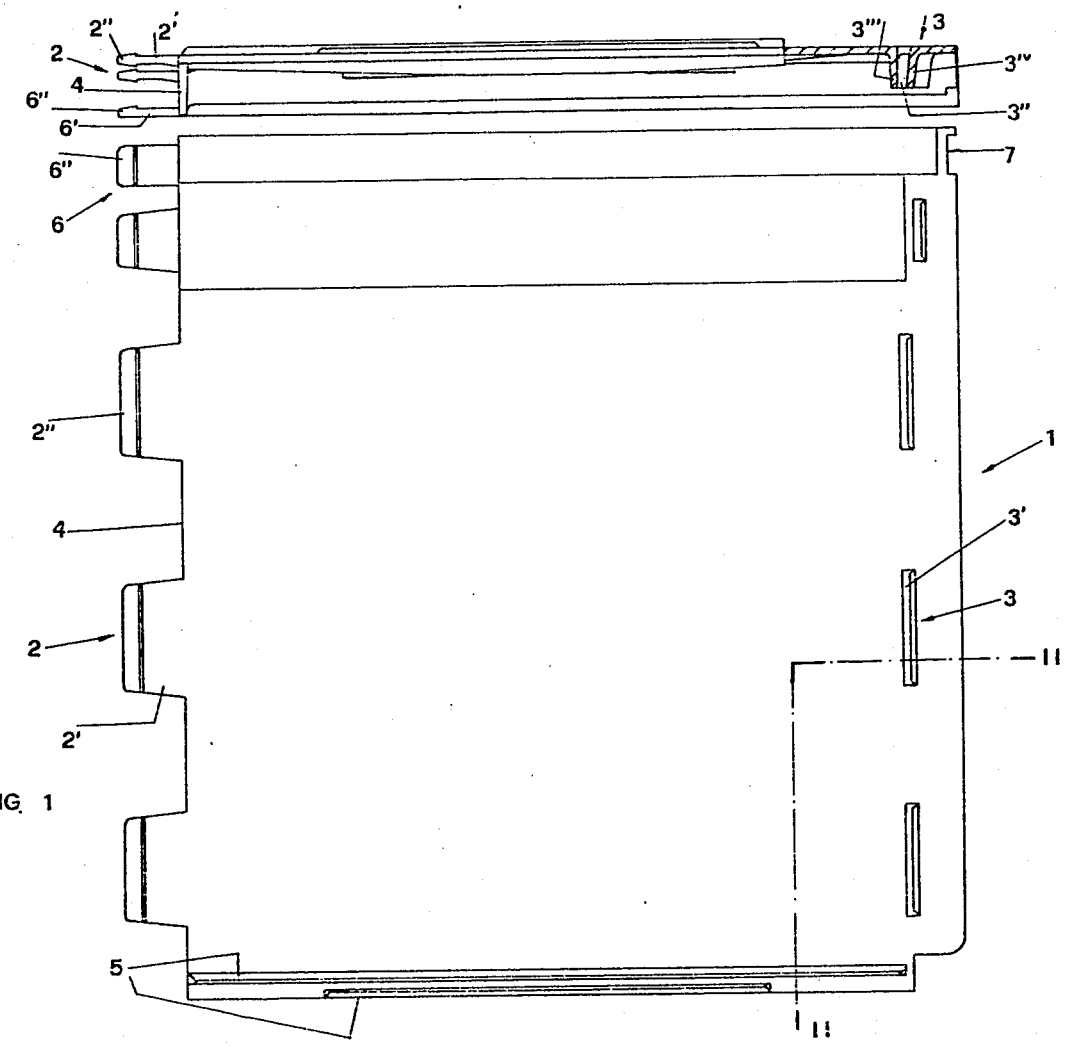
FIG. 2
FIG. 1

COMPOSABLE WELL

The present invention relates to a composable well capable, after it has been placed underground, to be used in hydraulic and sewer installations, as well as electrical and gas distribution installations and the like.

In the installations mentioned hereinabove there are frequently used wells made of a box-like monolithic structure made of cement or plastic material. These structures, after they have been placed underground, are used in hydraulic installations generally as vessels for collection or expansion or as a space for containing the connections in the sewers nets while in electric installations, and in the installations of gas distribution, they are used for the purpose of permitting either an easier operation of the installation, as well as easier inspection of the installation. These wells which have essentially a box-like shape are difficult to store and to transport because of the high dimensions so that the cost of transportation affects substantially the cost of the well for the final user, since the cost of transportation becomes almost identical to the production costs.

An object of the present invention is to eliminate the drawbacks mentioned hereinabove by providing a well of prismatic or right-cylindrical shape with a base which has respectively a polygonal or circular shape comprising a lateral surface constituted by a series of walls which present corresponding to one of the lateral borders some male type elements, and on the oppposite border, some female type elements of connection. The elements of male type present on each wall are intended to be inserted in the corresponding female type elements of the successive wall so that the elements of female type of each wall are intended to receive the corresponding elements of male type of the preceding wall. In actual practice each wall is restrained with two other similar walls corresponding to its lateral borders, the entire assembly being carried out with a simple application of pressure which permits the insertion of the elements of male type into the elements of female type without requiring screws, nails or other means of connection movable or fixed. In actual practice the elements of male type consist of sectors which are substantially planar and which end with an enlarged portion of trapezoidal shape. The segments of the larger base of this portion project externally and constitute the elements which permit the hooking with the elements of female type. The latter consists of a series of slits, the borders of which are prolonged rearwardly with two small walls disposed transversally with respect to the elements which constitute the box-like structure. One of the small walls is disposed perpendicularly with respect to the border of the slit, while the other is slightly inclined with respect to the border from which it departs so as to get close to the other small wall and invite the same. After the enlarged extremities of trapezoidal shape of the hooking sectors are inserted completely within the slits and within the following conduit which departs from them up to the stage when the hooking elements mentioned hereinabove go over the ends of the transversal small walls and are placed beyond the ledge against the same, the hooking between two adjacent walls is accomplished, after the time when the ends of trapezoidal shape cannot go back towards the mouth of the slits within which they have been inserted. Naturally, it is necessary to provide that the construction material of the small walls intended to hook up be sufficiently elastic, to permit the hooking operation described hereinabove. In fact, it is advantageous to make the entire device of plastic material by presswork. The width of the conduit which departs from each slit is smaller with respect to the width presented by the enlarged zone of the element of trapezoidal section. The insertion of the element of trapezoidal section in the slit and in the following channel is made possible clearly due to the elasticity of the material of which each wall is made and particularly the hooking element of the composable well.

It is obvious that the well may be transported from the place of production or commercialization to the place of utilization, still dismounted in the form of a series of superimposed walls which occupy little space and which are easy to handle. After they are in the final destination, the well may be easily assembled, hooking the elements of male type and female type one to the other to form a box-type structure with or without the bottom without the necessity of utilizing connection elements such as screws, nails and the like.

These and other characteristics of the invention will be described in more detail hereinbelow by reference to the accompanying drawings of which:

FIGS. 1, 2, 3, and 4 are respectively a front view, a bottom view, in partial cross-section according to line II—II of FIG. 1, a side view, and another front view corresponding to the face opposite with respect to the face of FIG. 1, of one of the walls which constitute the composable wall;

Figure 4:
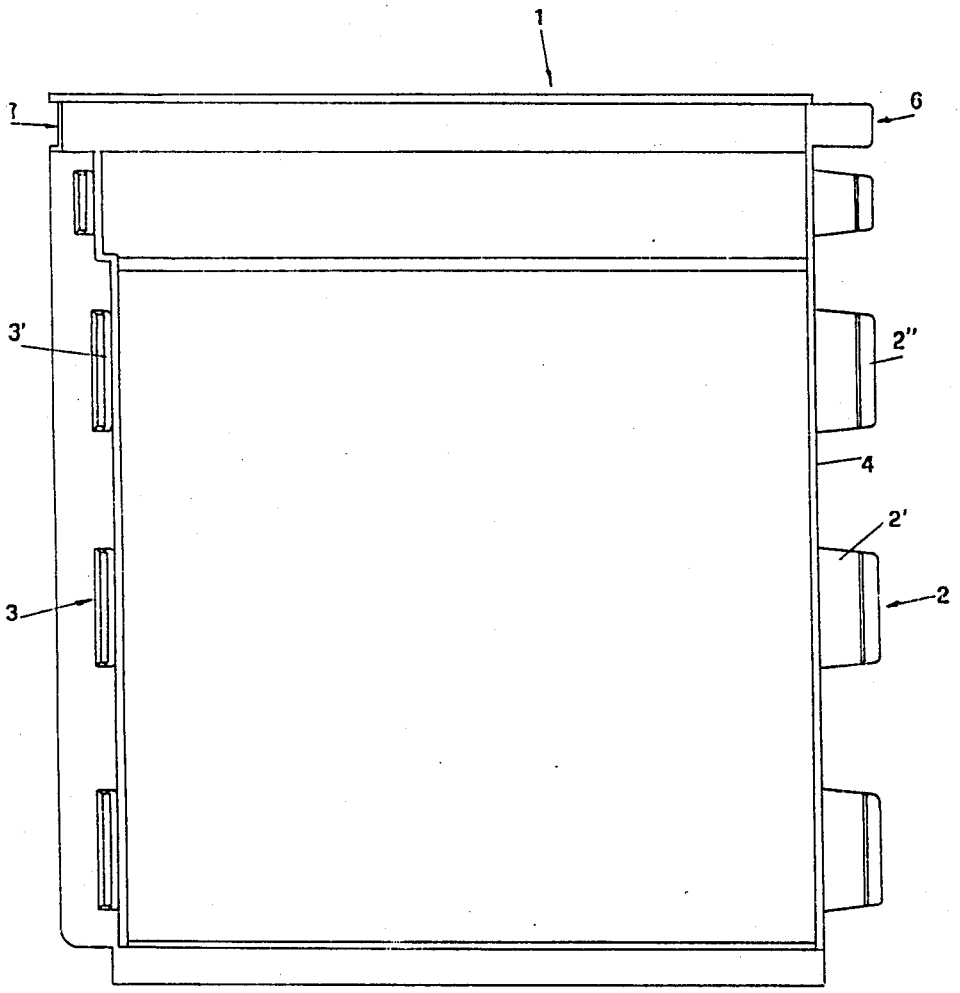

The figures show that the well is constituted by a series of walls (1) which in the figure are essentially planar and substantially rectangular, which when they are assembled along their lateral borders, are capable of forming a structure in the shape of a right prism. Preferable the base of the structure is of rectangular or square shape. It is also possible to provide that the walls have a curved shape so as to be able to constitute a structure of cylindrical shape. In each case, these walls present corresponding to their lateral borders on one side a series of hooking elements (2) of male type and on the other side a series of hooking elements (3) of female type. The hooking elements (2) are constituted by a sector (2') of substantially planar shape projecting towards the exterior with respect to the lateral border (4) of the wall, the sectors ending in a portion (2'') having an enlarged section and having the shape of an isosceles trapezium as shown in FIG. 2. On the other hand, the hooking element of female type consists of a slit (3') which constitutes the mouth of a conduit (3'') defined by a small wall (3''') perpendicular to wall (1) as well as another small wall (3') which is slightly inclined with respect to walls (1), and therefore slightly converging towards the other small wall (3''').

Figure 5:
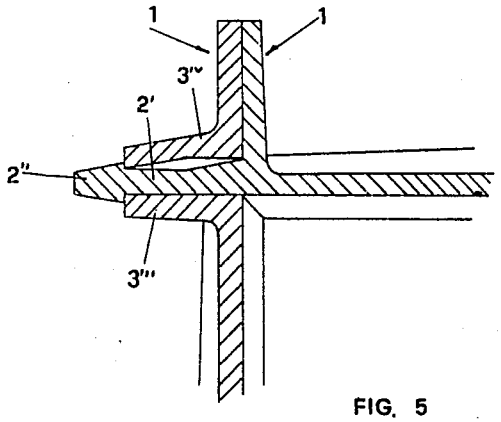
FIG. 5 is a view in transversal section of one of the hooking elements of male type inserted within a corresponding hooking element of female type.

By reference to FIG. 5, in order to carry out the reciprocal hooking between the elements of male type and female type, it is necessary to insert the sectors (2') within the conduit defined by the small walls (3''') and (3'). The distance between these two walls is less, particularly corresponding to its terminal part, with respect to the transversal maximum dimension of the enlarged portion (2') of trapezoidal section. The insertion of this element within the conduit is possible due to the fact that the entire wall (1) and in particular the small walls (3''') and (3') are made of elastic material, for instance, plastic material. After the entire sector (2') is inserted within the conduit and the terminal portion (2'') of enlarged section is placed beyond the terminal mouth of the same, it is clear that hooking between the elements is achieved, thus fixing solidly two walls corresponding to one of their lateral borders because the part which projects towards the exterior of the enlarged section (2'') of the sectors (2') is brought to be in position beyond the ledge against the extremities of the walls (3''') and (3') Further insertion of the sector (2') within the conduit is prevented due to the fact that the two walls (1) which must be joined are placed in contact and specifically the lateral border of the wall which has the elements of the male type is placed in contact with the internal face of the wall which has the elements of female type.

Figure 6:
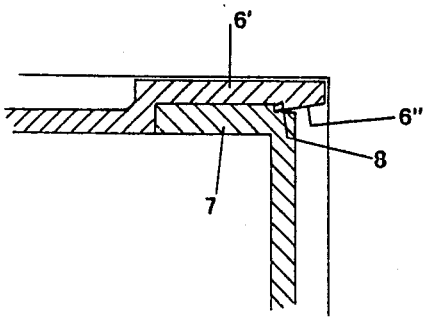
FIG. 6 is a transversal sectional view of two other hooking elements used in the device of the present invention in the position of reciprocal hooking.

In certain applications, the wall may be used with only the lateral surface and devoid of the lower surface, while in some other applications the presence of the base surface is essential. In this case, as shown in FIGS. 1 and 3 corresponding to the lower part of each of walls (1), on the face which is intended to be placed in the interior when the wall is assembled, there is provided a pair of relief ribs (5) which are disposed parallel to each other at a close distance suitable to hold for the thickness a planar bottom, not shown in the figure, which has shape and dimensions corresponding to the base of the same wall, capable of constituting the bottom closure of the well. FIGS. 1 and 4 also show that the walls (1) present in the upper part hooking element (6) formed also by a sector (6') which ends in an enlarged portion in the shape of a rectangular trapezium which therefore constitutes a single hooking element. On the opposite border of the wall (1) is present a recess (7) within which the sector (6') is intended to be located. This recess presents a cut-out portion (8) shown in FIG. 6 within which the portion (6'') of the sector (6') goes to place itself to project towards the exterior.

If it is desired to utilize a series of wells superimposed one on the other so as to create a multiple structure of axial dimension with respect to the height of the walls (1), it is possible to shape in suitable manner the upper extremities of the walls (1) so that the well after it is assembled presents in the upper part an opening of enlarged section with respect to the remaining portion of the well, the lower part of the wall being inserted within this opening, the lower part of the well similar to the one to which it is superimposed being inserted within this opening. Alternatively, a grating or a manhole cover or any other element of a planar shape may be inserted in this opening.

What is claimed is:

1. A composable well of right prismatic or right cylindrical shape, having a polygonal or circular base respectively, which consists of a plurality of walls (1) having lateral or vertical borders said walls having on the lateral borders thereof, on one side a plurality of hooking elements (2) of male type and on the opposite side thereof a plurality of hooking elements (3) of female type wherein the hooking elements (2) of male type consist of sectors (2') of substantial planar shape, said sectors being the extensions from one of said lateral borders of each of said walls (1), said sectors having at the end thereof a portion (2'') of enlarged section and in the shape of an isosceles trapezium, and wherein the hooking elements (3) of female type consist of a plurality of slits (3') which constitute the inlet mouth of a conduit defined by a pair of small walls (3''') and (3'), said pair of small walls being disposed essentially transversally with respect to each of said walls (1), the first of said small walls (3''') being perpendicular with respect to said wall (1), the second small wall (3') being slightly inclined with respect to said wall (1), whereby at the end of said conduit it is closer to said first small wall (3'''), said small walls being made of elastic material with a portion of the male hooking element passing through and beyond said pair of small walls.

2. The composable well according to claim 1 which comprises on the upper part thereof a second pair of hooking elements (6,7) of male and female type respectively, said pair of hooking elements consisting of a sector (6'), said sector being the extension of one of said lateral borders of said wall (1), said sector ending in an enlarged portion (6'') in the shape of a rectangular trapezium, said female type element consisting of a recess (7) formed in the opposite portion of said lateral border of said wall, said recess having a cut-out portion (8) along the entire height thereof whereby the border of said enlarged portion (6'') of said sector (6') of another wall (1) projecting towards the exterior is placed over the ledge formed by said cut-out portion.

3. The composable well according to claim 1 wherein corresponding to said lower border of said wall (1), along the internal surfaces thereof, two ribs in relief (5) are horizontally located and are placed at a limited reciprocal distance, said ribs being capable of holding the border of a lower closure plane forming the bottom of said well, said bottom having the shape and dimensions corresponding to the base of said well.

* * * * *